United States Patent [19]

Wang

[11] Patent Number: 4,582,437

[45] Date of Patent: Apr. 15, 1986

[54] PRINT PIN ACTUATOR AND METHOD OF MAKING SAME

[75] Inventor: Cheng-hua Wang, Nashua, N.H.

[73] Assignee: Centronics Data Computer Corp., Hudson, N.H.

[21] Appl. No.: 651,704

[22] Filed: Sep. 17, 1984

Related U.S. Application Data

[60] Division of Ser. No. 540,043, Oct. 7, 1983, Pat. No. 4,513,496, which is a continuation-in-part of Ser. No. 458,306, Jan. 17, 1983, abandoned.

[51] Int. Cl.[4] ..... B41J 3/12; B41J 3/10

[52] U.S. Cl. ..... 400/124; 400/174; 101/93.05

[58] Field of Search ..... 400/124, 157.1, 157.2, 400/166, 174, 175; 101/93.04, 93.05

[56] References Cited

U.S. PATENT DOCUMENTS

| | | | |
|---|---|---|---|
| 3,460,469 | 8/1969 | Brown et al. | 400/124 X |
| 3,592,311 | 7/1971 | Brown et al. | 400/124 |
| 3,672,482 | 6/1972 | Brumbaugh et al. | 400/124 |
| 3,768,403 | 10/1973 | Rose | 101/93.04 |
| 3,955,049 | 5/1976 | MacNeill et al. | 400/124 X |
| 4,037,704 | 7/1977 | Golobay et al. | 400/124 |
| 4,046,244 | 9/1977 | Velazquez | 400/124 |
| 4,136,978 | 1/1979 | Bellinger, Jr. et al. | 400/124 |
| 4,156,960 | 6/1979 | Ikeda | 400/124 X |
| 4,167,343 | 9/1979 | Golobay | 400/124 |
| 4,176,975 | 12/1979 | De Boskey et al. | 400/124 |
| 4,225,250 | 9/1980 | Wagner et al. | 400/124 |
| 4,233,894 | 11/1980 | Barrus et al. | 400/124 X |
| 4,273,039 | 6/1981 | Luo et al. | 400/124 X |
| 4,368,353 | 1/1983 | Ando et al. | 400/124 X |
| 4,389,127 | 6/1983 | Bellinger | 400/124 |
| 4,394,093 | 7/1983 | Asano et al. | 101/93.05 X |
| 4,403,875 | 9/1983 | Asano et al. | 400/124 |
| 4,484,519 | 11/1984 | Kurihara et al. | 101/93.05 |
| 4,498,388 | 2/1985 | Farb | 101/93.04 |

FOREIGN PATENT DOCUMENTS

| | | | |
|---|---|---|---|
| 78982 | 6/1981 | Japan | 400/124 |
| 38164 | 3/1982 | Japan | 400/124 |
| 47672 | 3/1982 | Japan | 400/124 |
| 142374 | 9/1982 | Japan | 101/93.05 |
| 188390 | 11/1982 | Japan | 400/166 |
| 166067 | 10/1983 | Japan | 400/124 |
| 215364 | 12/1983 | Japan | 400/124 |
| 2071019 | 9/1981 | United Kingdom | 400/124 |

OTHER PUBLICATIONS

IBM Tech. Disc. Bulletin, "Print Hammer Adjustment Means", Helinski, vol. 24, No. 3, Aug. 1981, pp. 1700–1701.

"Optimizing the Performance of an Electromechanical Print Mechanism", Baily et al., Hewlett-Packard Journal, Nov. 1978, pp. 23–31.

*Primary Examiner*—Edgar S. Burr
*Assistant Examiner*—James R. McDaniel
*Attorney, Agent, or Firm*—Henry D. Pahl, Jr.

[57] ABSTRACT

The high speed print pin actuator disclosed herein is constructed as two sub-assemblies, a U-shaped fixed magnet structure and an armature sub-assembly. One leg of the U-shaped structure constitutes a coil core and the other includes a permanent magnet and a keeper plate, the ends of the keeper and the core being finished to a common plane. The armature assembly includes a flux return bridge structure which extends from the keeper to a region adjacent the end of the coil core and which is bifurcated to receive an armature which is selectively attracted to the coil core. The armature is carried on a spring which is, in turn, mounted on the bridge structure. With the spring in a deflected position, the armature is finished to a common surface with the portion of the bridge which mates with the magnet structure. Accordingly, assembly of the armature sub-assembly with the U-shaped fixed magnet structure is facilitated and accurate parallelism of the armature and pole piece is provided. Preferably, a thin shim of a wear resistant material is interposed between the spring and the bifurcated portion of the bridge structure.

7 Claims, 9 Drawing Figures

PRINT PIN ACTUATOR AND METHOD OF MAKING SAME

REFERENCE TO RELATED APPLICATION

This is a division of application Ser. No. 540,043, filed 10-7-83, now U.S. Pat. No. 4,513,496, which is a continuation-in-part of application Ser. No. 458,306 filed on 1-17-83, now abandoned.

BACKGROUND OF THE INVENTION

The present invention relates to a high speed pin actuator for dot matrix printing and to a method of efficiently fabricating such an actuator. As is understood by those skilled in the printing arts, dot matrix impact printing is typically accomplished by a printhead carrying a plurality of printing pins, each of which is selectively operated by a magnetic actuator. The pins are typically arrayed in a vertical line and, as the head is traversed across a sheet of paper, the actuators are energized in the appropriate sequence to print characters sequentially across the paper. While throughput and character image resolution are particularly functions of the number of pins and actuators which are available, both the printer throughput and the accuracy of the formed characters are also highly dependent upon the speed at which the actuator can be operated.

Among the several objects of the present invention may therefore be noted the provision of a pin actuator for dot matrix printing with is operable at high speed; the provision of such an actuator which is compact and light weight so that a multiplicity of such actuators can be included in a single printhead; the provision of such an actuator which can be efficiently manufactured in large quantities; the provision of such an actuator which can be manufactured at relatively low cost; the provision of such an actuator which provides highly reproducible results from device to device; the provision of such an actuator which is highly reliable and is of relatively simple and inexpensive manufacture. Other objects and features will be in part apparent and in part pointed out hereinafter.

SUMMARY OF THE INVENTION

The pin actuator of the present invention is manufactured in two sub-assemblies, a generally U-shaped fixed magnetic structure an an armature sub-assembly. One leg of the U-shaped structure includes a permanent magnet polarized along the length of the leg and a keeper which forms the end of that leg. The coil surrounds the other leg of the fixed magnetic structure, the end of the core leg constituting a pole piece which is finished to a common plane with the end of the keeper. The armature assembly includes a flux return bridge which has a flat surface mating with the magnet structure and a portion of which extends from the keeper to a region adjacent the pole piece. The extending portion of the bridge is bifurcated in the plane of the U-shaped fixed magnet structure and a plate-like spring is mounted on the side of the bridge opposite the fixed magnet structure. A printing pin is carried on the free end of the spring and extends generally perpendicular to the nominal plane of the spring. The rest position of the spring is generally parallel to the flat surface. An armature carried by the spring extends through the bifurcation in the bridge member. The surface of the armature facing the pole piece is finished to a common plane with the flat surface on the bridge while the spring is in a deflected position corresponding to the desired travel of the pin.

In a preferred embodiment, a thin flat shim is interposed between the flat surface of the bridge member and the keeper to establish a precisely defined air gap between the armature and the pole piece. Preferably also, a wear resistant shim is interposed between the spring and the bifurcated portion of the bridge to reduce shifting of the start position of the stroke of the printing pin.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
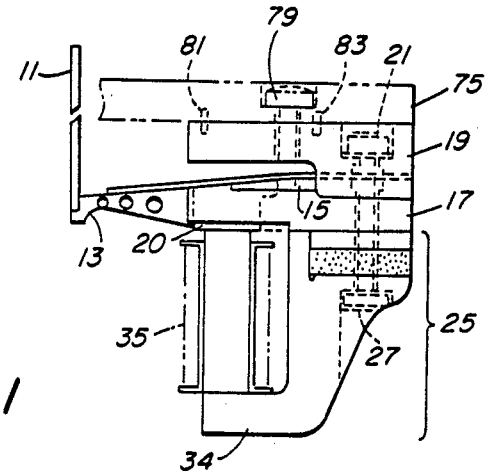
FIG. 1 is a side view of a high speed printing pin actuator for a dot matrix printer constructed in accordance with the invention.

Referring now to FIG. 1, it may be noted that the actuator illustrated there may be considered to be of the stored energy type, that is actuation of the printing pin to achieve a printing impact is accomplished by releasing energy stored in a spring rather than by applying energy generated through actuation of an electromagnet. As illustrated in FIG. 1, a printing pin 11 is, through an arm 13, mounted on the free end of a flat or plate-like spring 15. The fixed end of spring 15 is clamped between a flux return block or bridge 17 and a mounting block 19, these elements being secured together by a screw 21. A magnetic yoke or generally U-shaped fixed magnetic structure 25 is also mounted on the bridge 17, i.e. by a screw 27.

Figure 2:
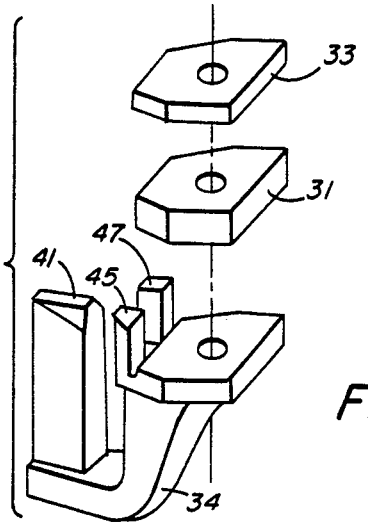
FIG. 2 is an exploded view of elements of a fixed magnetic structure sub-assembly employed in the actuator of FIG. 1.
Figure 3:
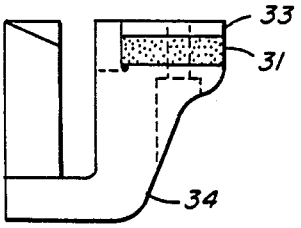
FIG. 3 shows the elements of FIG. 2 assembled.
Figure 5:
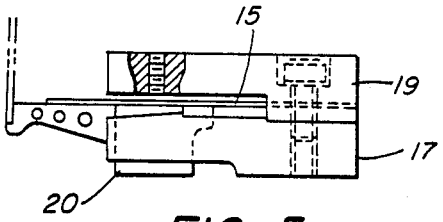
FIG. 5 is a side view showing the elements of FIG. 4 assembled.

As illustrated in greater detail in FIGS. 2 and 3, the right hand leg of the magnetic yoke includes a plate or wafer-like permanent magnet 31, as well as a keeper plate 33. The remainder of the yoke is formed by a magnetically permeable core part 34. A coil 35 surrounds the other leg of the core 34 and the free end of this leg may be considered as terminating in a pole piece or pole face 41. Preferably, a high energy magnetic material, such as samarium cobalt, is used for the permanent magnet 31. In that these materials exhibit relatively low permeability, the core leg including the permanent magnet preferably flares to provide a broad face yielding an appropriate magnetic impedance match to the permanent magnet. While the leg including the permanent magnet is thus relatively thick, the other leg, the coil core, is kept as thin as possible and is of tapered cross section, as illustrated, in order to maintain a desirable form factor for inclusion in an overall print head as described hereinafter.

Figure 4:
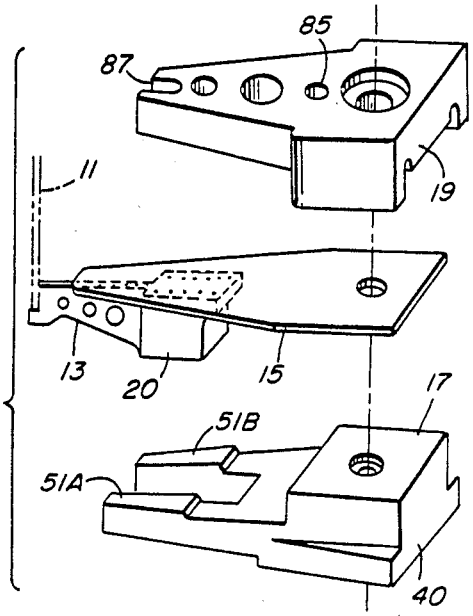
FIG. 4 is an exploded view of elements of an armature sub-assembly employed in the actuator of FIG. 1.

As may be seen best in FIG. 4, the flux return block or bridge 17 is bifurcated, the bifurcation being generally in the plane of the U-shaped fixed magnetic structure 25. The plate-like spring 15 carries an armature 20 which extends through the bifurcation into proximity with the end of the coil core, i.e. the pole piece 41.

In the absence of any energization of the coil 35, the magnetic polarization provided by the permanent magnet 31 causes the armature 20 to be attracted to the pole piece 41. This is the normal or rest posture of the actuator, as illustrated in FIG. 1. In order to operate the actuator, the coil 35 is energized in a sense to produce a polarization opposing that generated by the permanent magnet 31. This opposing magnetomotive force substantially neutralizes the flux at the interface between the pole piece 41 and the armature 20, allowing the spring 15 to drive the printing pin forward, i.e. into contact with a ribbon and a paper to effectuate printing.

In the construction illustrated, the spring 15 can be relatively stiff and thus relatively high speed operation can be obtained. However, in order to provide a very rapid cancellation in the flux at the contact surface, a shunt path is provided which bypasses the permanent magnet. The purpose of the shunt is to provide a high permeability path for the flux generated by the coil in opposition to the permanent magnet. As indicated previously the materials presently preferred for the permanent magnet are not highly permeable and thus would not provide an easy path for this transitional flux. The shunt path is provided by two posts 45 and 47, as may be seen best in FIG. 2, which are formed as part of the core part 34 and which extend up beside the magnet 31 in a close proximity with the keeper 33 and the flux return block 17. In addition to providing the desired magnetic shunting effect, the posts 45 and 47 also serve to help locate the permanent magnet 31 and keeper plate 33 during assembly when it is placed in abutment with these posts.

A substantial advantage of the present design is that the actuator can be fabricated efficiently and accurately so that consistent and reliable operation can be achieved, while at the same time achieving a low cost of manufacture. As will be understood, cost is particularly important when the actuators are manufactured in large numbers, multiple such actuators being employed in each printing apparatus. As illustrated in FIGS. 2 and 3, the magnet and keeper plate are initially assembled with the yoke core 34 and are cemented in position. As may be seen, the posts 45 and 47 provide an abutment against which the magnet and keeper plate may be aligned in proper position with respect to the yoke core. After assembly and cementing, the top surface of the keeper plate and the top surface of the pole piece are finished, e.g. by grinding, to a common plane as illustrated in FIG. 3. As will be understood, this finishing step nullifies any minor inaccuracies in the mating surfaces of the components of the fixed magnet structure which might otherwise accumulate and cause misalignment with the armature when the fixed magnetic structure is assembled with the armature sub-assembly. With the assembly technique, the yoke part 34 can typically be manufactured simply by investment casting with no further operation except for rough flattening, e.g. by coining, of the surface which mates with the permanent magnet.

As indicated previously, the spring 15 which carries the armature 20 is clamped between the flux return block or bridge 17 and a mounting block 19 and the bridge element 17 includes a flat surface 40 which mates with the top surface of the keeper plate 33 upon assembly. The portions of the bifurcated bridge element 17 which extend over the pole piece are provided, on the side opposite the pole piece, with inclined surfaces 51A and 51B (see FIG. 4 and FIG. 6). The inclination of these surfaces corresponds to a deflected position of spring 15, the amount of the deflection being chosen to correspond to a desired throw of the printing pin 11. As with the core part 34, the bridge element can be manufactured at low cost by investment casting with no further finishing except a simple flattening of surfaces which mate with other parts.

Figure 6:
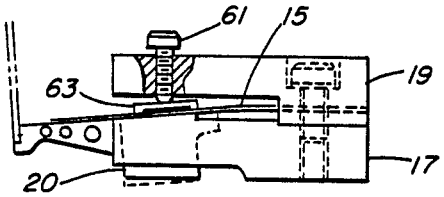
FIG. 6 shows the armature assembly clamped by tooling for a finishing operation.

The armature 20 is initially constructed so as to be oversize. After the spring 15, bridge element 17, and mounting block 19 are assembled, the spring is deflected down into contact with the surfaces 51A and 51B as illustrated in FIG. 6. As illustrated, this deflection is provided by means of a screw 61 threaded into a mating threaded hole in the mounting block together with a force spreading shim 63. It will be understood, however, that other forms of tooling might also be used. With the spring in the deflected position as shown in FIG. 6, the armature is finished, e.g. by grinding, to a common plane with the flat surface 40 on the flux return block. Since the pole piece surface 41 and the keeper plate surface on which the bridge mounts are also finished to a common plane, it can be understood that very precise alignment or parallelism between the armature and the pole piece can be assured by these two relatively simple finishing operations, e.g. since each of the two operations merely involves establishing a single plane surface with a requisite degree of flatness.

Figure 7:
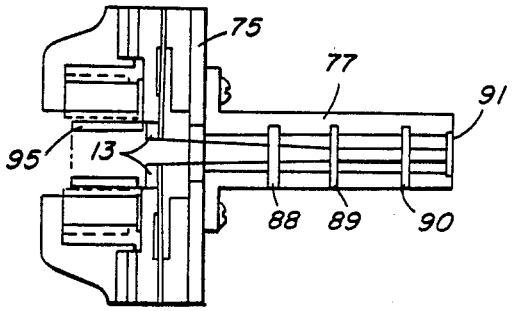
FIG. 7 is a side view, partially in section, illustrating the manner in which a plurality of the actuators of FIG. 1 are assembled into a printhead suitable for incorporation in a dot matrix printer.
Figure 8:
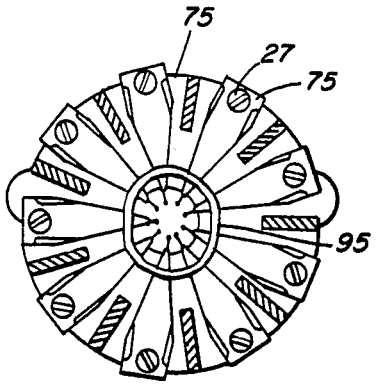
FIG. 8 is a rear view of an assembled printhead.

As indicated previously, a plurality of pin actuators are typically mounted together in a printhead assembly. Such an assembly is illustrated in FIGS. 7 and 8. In addition to multiple actuators, the printhead comprises a common mounting plate 75 and a nose piece 77. Each of the actuators is mounted to the mounting plate 75 by means of a screw 79 and a pair of pins 81 and 83 which engage an aperture 85 and a slot 87 in the actuator mounting block 19 to assure alignment (FIG. 4). The actuator mounting block is preferably constructed of a suitable non-magnetic material, e.g. aluminum formed by die casting. The printing pins or wires extend down the nose piece 77 through successive guides 88–90 to a jewel assembly 91 which holds the operating ends of the wires in the desired array in conventional manner.

As it has been found that the life of the armature and pole piece can be further extended if slight lubrication is provided, the printhead assembly preferably further includes a ring of oiled felt 95 which bears lightly against the arms 13 which extend from the springs 15. Oil from the felt will find its way along each arm and spring to the interface with the respective pole piece. Conventional watch oil is the presently preferred lubricant in that it is relatively non-volatile and will last for years without replacement. Other than the portion which bears against the actuator arms, the oiled felt is preferably contained in a plastic holder which inhibits unwanted migration of the oil in other directions.

Figure 9:
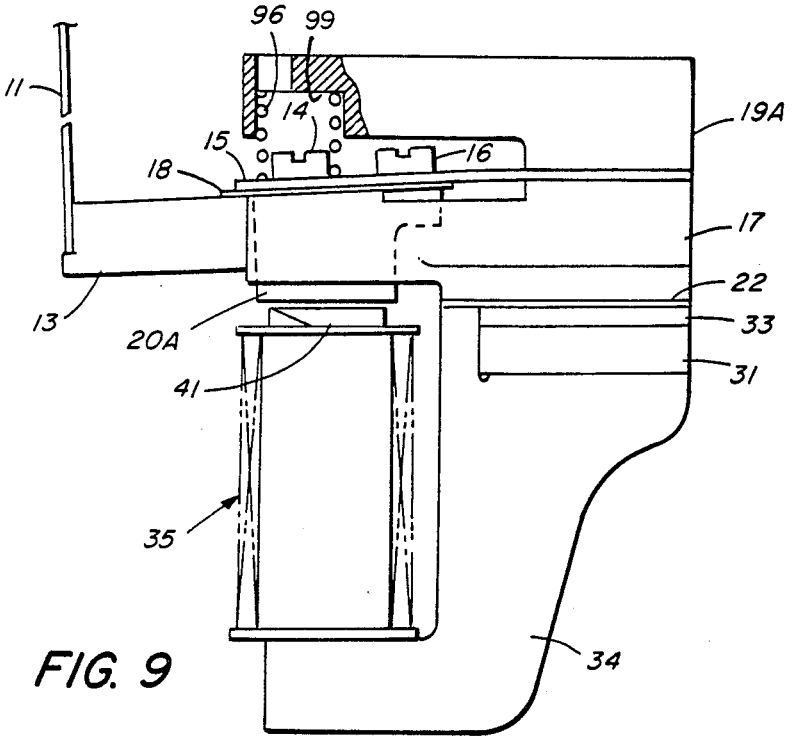
FIG. 9 is a side view of a slightly modified actuator constructed in accordance with the invention.

The modified embodiment illustrated in FIG. 9 retains the manufacturing and other advantages of the embodiment of the previously described embodiment while providing increased life and even faster operation. Referring now to that drawing, it will be seen that the fixed magnet structure is essentially identical to that used in the embodiment of FIG. 1 and the armature assembly is quite similar. In the FIG. 9 embodiment, however, the armature 20A is secured to the plate-like spring 15 by screws 14 and 16 rather than being spot welded thereto and a thin flat anti-wear shim 18 is clamped to the spring by the armature. This anti-wear shim covers the full width of the spring so as to be interposed between the spring and the inclined surfaces (51A and 51B) of the bifurcated portion of the bridge structure 17. A preferred material for the anti-wear shim 18 is a polyamid film such as that sold commercially under the trade name "KAPTON" by the Eastman Kodak Company of Rochester, N.Y. A film thickness of 0.002 inch is appropriate. As in the method described previously, the surface of the armature facing the pole piece is ground to common plane with the flat surface 40 of the bridge member 17 when the spring is in its deflected position, though this position is very slightly altered by the presence of anti-wear shim 18 which, in the deflected position, is interposed between the spring and the bifurcated portion of the bridge member.

In the construction of FIG. 9, an additional shim 22 is interposed between the keeper 33 and the mating flat surface of the bridge 17. This shim provides a predetermined air gap between the armature and the pole piece when the spring is in the deflected initial position as shown. Shim 22 is preferably constructed of a magnetically permeable material such as cold rolled steel. A thickness of 0.002 inches is appropriate, thereby providing an air gap of 0.002 inches.

As will be understood, the overall effect of the adding of the two shims is to transfer the impact upon resetting of the armature to the interface between the spring and the inclined surfaces on the bifurcated portion of the bridge 17 and to remove such impact load from the armature/pole piece interface. Accordingly, wear of those later elements is substantially eliminated and the gradual shift in the starting position of the print pin is similarly reduced. It has also been found that the presence of the small air gap shortens the response time of the actuator, i.e. the armature will release more quickly, so that even faster operation is possible. To offset the slight reduction in holding force caused by the air gap, a coil spring was added as indicated at 96. One end of spring 96 rests around screw 14 while the other end is located in a recess 99 formed in the mounting block 19A.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A high speed pin actuator for dot matrix printing which comprises:

a generally U-shaped fixed magnet structure having a first leg and a core leg, each of said legs having free end said first leg of said U-shaped structure including a permanent magnet polarized along a line parallel to the long axis of said first leg and a keeper plate, which keeper plate has a mating surface that forms the free end of said first leg;

a coil surrounding said core leg of said fixed magnet structure, said core leg forming a core for said coil, the free end of the core leg and the end mating surface of said keeper being finished to tie in a common plane;

an armature assembly at the free ends of said U-shaped fixed magnet structure, said armature assembly including:

a bridge member having a flat surface said flat surface mating with said mating surface of said keeper and which extends from said keeper to a region adjacent the end of the core leg, said bridge being bifurcated generally in the plane of the U-shaped fixed magnet structure;

a plate-like spring juxtaposed to the side of said bridge opposite the fixed magnet structure, said spring having a free end, the rest position of said spring being generally parallel to said common plane;

an armature carried by said spring extending through the bifurcation in the bridge, the surface of the armature facing the core leg being finished to lie in a common plane with said flat surface of the bridge member when the spring is in a deflected position; and a print pin carried on the free end of the spring.

2. An actuator as set forth in claim 1 wherein said keeper and the U-shaped fixed magnet structure, except for the permanent magnet, are constructed of a permeable iron material and wherein said structure includes a permeable shunt structure bridging said permanent magnet providing a path for flux components generated by said coil and opposing the permanent magnet field.

3. An actuator as set forth in claim 2 wherein said shunt structure is on the side of said permanent magnet adjacent said coil and wherein said permanent magnet and said keeper abut and are thereby located by said shunt structure.

4. An actuator as set forth in claim 1 wherein a thin shim of a wear resistant material is interposed between said spring and the bifurcated portion of said bridge.

5. An actuator as set forth in claim 1 wherein a thin flat shim is interposed between said bridge member flat surface and said keeper for establishing a predetermined air gap between said armature and said pole piece when said spring is in its deflected position.

6. A high speed pin actuator for dot matrix printing which comprises:

a generally U-shaped fixed magnet structure, having a first leg and a core leg, each of said legs having a free end said first leg of said U-shaped structure including a permanent magnet polarized along a line parallel to the long axis of said first leg and a keeper plate, which keeper plate has a mating surface that forms the free end of said first leg;

a coil surrounding said core leg of said fixed magnet structure which forms a core for said coil, the free end of the core leg and the mating surface of said keeper being finished to lie in a common plane, the end of the core leg constituting a pole piece;

an armature assembly at the free ends of said U-shaped fixed magnet structure, said armature assembly including:

a bridge member having a flat said flat surface surface mating with said mating surface of said keeper and which extends from said keeper to a region adjacent the pole piece, said bridge being bifurcated generally in the plane of the U-shaped fixed magnet structure;

a plate-like spring juxtaposed the side of said bridge opposite the fixed magnet structure, said spring having a free end, the rest position of said spring being generally parallel to said common plane;

an armature carried by said spring extending through the bifurcation in the bridge, the adjacent portion of the bridge member between the spring and pole piece being shaped to conform to a deflected position of the spring bringing the armature to the pole piece, the surface of the armature facing the pole piece and being finished to lie in a common plane with the said flat surface of the bridge member when the spring is in its deflected position; and a printing pin carried on said free end of the spring and extending generally perpendicular to the nominal plane of the spring in a direction away from the fixed magnet structure.

7. A high speed pin actuator for dot matrix printing which comprises:

a generally U-shaped fixed magnet structure having a first leg and a core leg, said first, leg of said U-shaped structure including a permanent magnet polarized along a line parallel to the long axis of said first leg and a keeper plate, which keeper has a mating surface, forms the free end of that leg;

a coil surrounding said core leg of said fixed magnet structure which forms a core for said coil, the free end of the core leg and the mating surface of said keeper being finished to lie in a common plane, the end of the core leg constituting a pole piece;

an armature assembly at the free ends of said U-shaped fixed magnet structure, said armature assembly including:

a bridge member having a flat surface said flat surface mating with said mating surface of said keeper and which extends from said keeper to a region adjacent the pole piece, said bridge being bifurcated generally in the plane of the U-shaped fixed magnet structure, to provide a pair of arms over said pole piece;

a plate-like spring juxtaposed to the side of said bridge opposite the fixed magnet structure, said spring having a free second end, the rest position of said spring being generally parallel to said common plate, the bridge member arms providing inclined surfaces corresponding to a deflected position of said spring;

an armature carried by said spring and extending through the bifurcation in the bridge;

interposed between said spring and said arms, a thin shim of a wear resistant material;

the surface of the armature facing the pole piece and being finished to lie in a common plane with said flat surface of the bridge member when the spring is in its deflected position;

a printing pin carried on said free end of the spring and extending generally perpendicular to the nominal plane of the spring in a direction away from the fixed magnet structure; and interposed between said flat surface on said bridge member and said keeper, a thin flat shim for providing a predetermined air gap between said armature and said pole piece when said spring is in its deflected position.

* * * * *